United States Patent [19]

Futamase et al.

[11] 4,000,675

[45] Jan. 4, 1977

[54] ELECTRONIC MUSICAL INSTRUMENT

[75] Inventors: Tsuyoshi Futamase; Masanobu Chibana, both of Hamamatsu, Japan

[73] Assignee: Nippon Gakki Seizo Kabushiki Kaisha, Japan

[22] Filed: Nov. 21, 1975

[21] Appl. No.: 634,306

[30] Foreign Application Priority Data

Nov. 25, 1974 Japan ..... 49-135728

[52] U.S. Cl. ..... 84/1.01; 84/1.03; 84/1.26

[51] Int. Cl.[2] ..... G10H 1/00; G10F 1/00; G10H 1/02

[58] Field of Search ..... 84/1.01, 1.03, 1.24, 84/1.26, 1.27; 340/172.5

[56] References Cited

UNITED STATES PATENTS

| | | | |
|---|---|---|---|
| 3,809,786 | 5/1974 | Deutsch | 84/1.03 |
| 3,823,390 | 7/1974 | Tomisana et al. | 84/1.01 |

*Primary Examiner*—E. S. Jackmon

*Attorney, Agent, or Firm*—Ladas, Parry, Von Gehr, Goldsmith & Deschamps

[57] ABSTRACT

An electronic muscial instrument capable of calculating level information of slope portion of a filter characteristic on the basis of the inclination of the slope and the cut-off frequency without requirement of storing level information of the slope portion for each individual frequency.

The inventive electronic musical instrument is also capable of obtaining level information of an acute portion of filter characteristic which constitutes selectivity Q by calculating the inclination and peak value of the acute portion and difference between the peak frequency and the cut-off frequency.

An example is shown in which the cut-off frequency is caused to successively change during a period of time from the start to the end of playing of a musical tone and in which the peak of the selectivity Q can be directed either upward or downward as desired.

5 Claims, 9 Drawing Figures

ELECTRONIC MUSICAL INSTRUMENT

BACKGROUND OF THE INVENTION

This invention relates to an electronic musical instrument of a type in which harmonic components are digitally combined to form a musical tone and, more particularly, to an electronic musical instrument of the above mentioned type capable of performing a filter function required for characterizing a tone color by digital computation.

A filter used in a prior art digital type electronic musical instrument consists of a memory which digitally stores level information of a slope portion of a filter characteristic. The slope portion means an attenuation region of frequency which is lower than cut-off frequency (in a high-pass filter) or higher than cut-off frequency (in a low-pass filter). Level information stored in the memory is read out in response to information corresponding to frequency. According to this prior art filtering device, the memory must store all level information corresponding to frequencies in the attenuation region so that it must have a large storing capacity. This naturally results in increase in the cost of manufacture. If, for example, required resolution (i.e. minimum unit of the variation steps of attenuation) is 0.75dB and dynamic range of the attenuation is 0–48 dB, the memory must have a storing capacity of 384 bits. If dynamic range increase to 0–72 dB, the required storing capacity increase to 672 bits. If, further, required resolution increases to 0.1875 dB, the required storing capacity increases to 3456 bits. It will be understood from these examples that a memory of a large storing capacity is required if an improved resolution is desired.

SUMMARY OF THE INVENTION

It is an object of the present invention to provide an electronic musical instrument which has eliminated the above described disadvantage of the prior art instrument.

It is another object of the invention to provide an electronic musical instrument capable of successively calculating a function formula for obtaining level information of the slope portion of a filter characteristic in accordance with each individual frequency without using a memory which stores level information of the slope portion for each individual frequency and thereby achieving a compact and low-cost construction of the filter.

It is still another object of the invention to provide an electronic musical instrument comprising a filter portion capable of calculating a functional formula for obtaining information of the slope portion of the selectivity Q in accordance with each individual frequency and also capable of changing difference between the cut-off frequency and the frequency of the selectivity Q as desired.

The basic principle of the invention will now be described. The digital type filter according to the invention calculates a functional formula concerning a slope portion S of a filter characteristic shown by a solid line in FIG. 1. If the slope portion S is expressed in a primary function, level information Y is obtained by calculating the following formula (1):

$$Y = aX \tag{1}$$

where $X$ represents abscissa, i.e. frequency information and $a$ represents inclination of the slope, i.e. amount of octave attenuation. A point at which the slope S starts is a cut-off frequency COF. If actual frequency is represented by F, the frequency information utilized for calculation of the slope portion S is obtained by the following formula (2):

$$Y = \log F - COF \tag{2}$$

In the formula (2), the cut-off frequency COF is expressed in a logarithmic form. Accordingly, level information Y of the actual frequency F can be obtained by presetting the inclination $a$ which is a constant and the cut-off frequency COF and conducting calculation on the basis of the formula (2) and then the formula (1). According to this arrangement, a memory has only to memorized information concerning the inclination $a$ and the cut-off frequency COF so that a memory of a relatively small storing capacity will sufficiently serve for the purpose. The level information Y thus obtained by calculation is used for controlling levels of corresponding frequencies (harmonic components) whereby filtering function is substantially performed.

The arrangement according to the invention is convenient in that amount of octave attenuation can be determined as desired by suitably selecting the inclination $a$. The cut-off frequency can also be determined as desired by suitably selecting the value of the cut-off frequency information COF. If, for example, calculation on the basis of the formulas (1) and (2) is conducted with the cut-off frequency information COF being shifted to a value which is higher than the filter characteristics as shown by the solid line in FIG. 1, the slope portion will be shifted to a higher frequency region as shown by a dotted line in FIG. 1.

Furthermore, according to the invention, selectivity Q of the filter can also be obtained approximately on the basis of a similar principle. More specifically, level information of an acute portion of the filter characteristic which constitutes the selectivity characteristic is obtained by conducting calculation similar to the above described calculation and this level information of the selectivity Q is combined with the level information of the normal filter characteristic to produce single filter level information.

A preferred embodiment of the invention will be described with reference to the accompanying drawings.

DETAILED DESCRIPTION OF A PREFERRED EMBODIMENT

Figure 2:
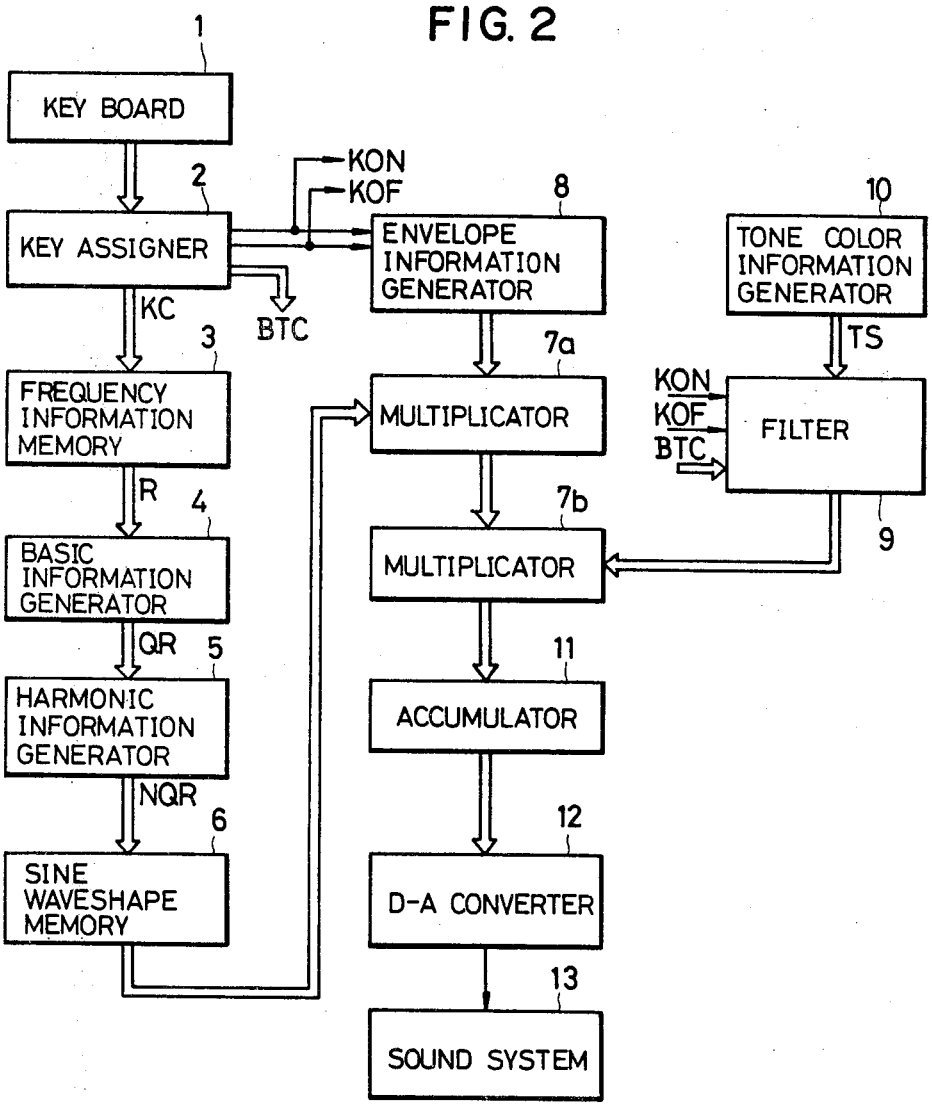
FIG. 2 is a block diagram schematically showing an entire construction of the preferred embodiment of the electronic musical instrument according to the invention.

FIG. 2 is a block diagram schematically showing the entire construction of the electronic musical instrument according to the invention. The basic concept of the entire construction is to calculate amplitude values of respective harmonics of a musical tone waveshape to be produced at respective sample points with a regular time interval, multiply the amplitude values with amplitude coefficients (levels) of the respective harmonics characterizing the tone color of the musical tone and thereafter cumulatively add all the harmonic components to form the desired musical tone waveshape. This basic construction has already been described in U.S. Pat. No. 3,809,786 so that detailed description of the entire construction will be omitted and a filter 4 which constitutes an important feature of the present invention will be described in detail.

A key assigner 2 produces key address codes KC representing the key names of depressed keys in response to key-on information supplied from a keyboard circuit 1. These key address codes KC are allotted in a time sharing manner to respective channels corresponding to a maximum number of tones to be reproduced simultaneously and are read out sequentially and successively at each channel time. The key assigner also produces various clock pulses or time-shared information used for defining time shared slots and controlling time-shared synchronized operation of respective unit constituting the instrument. Assume, for example, that the inventive electronic musical instrument uses higher harmonic and that a maximum number of tones to be produced simultaneously is eight. Clock pulse are counted by a first counter of eight stages (not shown) to form time sharing time slots for each harmonics and the frequency divided output of this counter is further counted by a second counter of eight stages (not shown) to form time sharing time slots for each of channels corresponding in number to the maximum number of tones to be produced simultaneously. The output of the first counter is hereinafter referred to as an order-of-harmonic signal BTC. This signal BTC is utilized for forming regular time interval of calculation required to produce the respective harmonic components as will be described later.

A frequency information memory 3 previously stores frequency information R which is a value proportionate to the frequency of each tone. Frequency information R corresponding to the depressed key is read out in response to contents of key address code KC.

A basic information generator 4 cumulatively counts with a certain interval (e.g. every 8 channel times) frequency information R read out in time sharing from the frequency information 3 at each channel time thereby forming basic information $QR$ ($Q=1, 2, 3 \ldots$) to be used for producing harmonic information. The phase of the fundamental wave is determined by this basic information. The basic information $QR$ is generated in time sharing with respect to the eight tones and the value of the basic information does not change during one channel time.

The output QR of basic information generator 4 is applied to a harmonic information generator 5.

In the harmonic information generator 5, the basic information QR is sequentially and cumulatively counted at a high time sharing rate corresponding to the order-of-harmonic signal BTC and produces in time sharing address information $NQR$ ($N=1, 2 \ldots, 8$) which constitutes address for respective sample points for reading out waveshape information of 8 harmonics per tone (the 8 harmonics includes the fundamental and seven overtone partials). This determines phase angles of the respective harmonics. Wave values at the respective sample points stored in a sine waveshape memory 6 are read out in response to the address information NQR.

In a first multiplicator **7*a*, the wave value information is multiplied with envelope information from an envelope information generator 8 by each tone (i.e. by each channel) to deliver to a second multiplicator 7*b* envelope imparted waveform information. The envelope information generator 8 generates in a time sharing manner envelope information including attack, decay, sustain and release by each of the tones to be reproduced simultaneously, i.e. every channel time, in response to the key-on and key-off information from the key assigner 2.**

In the second multiplicator **7*b*, the envelope-imparted waveform information is multiplied with level information of respective harmonics from the filter 9 by each harmonic to produce waveform information of the respective harmonic components which are controlled in their tone color. Thus, waveform information of the respective harmonic components (controlled in tone color and envelope) is successively calculated with regular time interval and thereafter applied to an accumulator 11. The accumulator 11 adds the waveform value information from the fundamental wave to the eighth (n-th) harmonic together by each tone (i.e. for each channel time) to produce a single composite musical tone waveshape. If desired, the wave values of the respective tones may be added together by the kind of keyboard. The musical tone waveshape information of the composite harmonic contents is applied to a digital-analog converter 12 where it is converted to an analog waveshape signal and thereafter is sounded through an acoustic system 13.**

If the wave value information read from the sine waveshape memory 6, envelope information from the envelope information generator 8 and level information from the filter 9 are expressed in logarithm, simple adders may be used as the multiplicators **7*a*, 7*b*,** It will be noted that the respective component parts of the apparatus operate in complete synchronization by the same harmonic order of the same channel.

A tone color information generator 10 produces tone color information TS for realizing a tone color selected by the performer by operation of tone lever is (not shown). This tone color information TS is information defining the levels of the respective harmonics at predetermined relative ratios. The filter 9 performs the above described digital type filtering function and produces level information of a desired filter characteristic by calculation.

Figure 3:
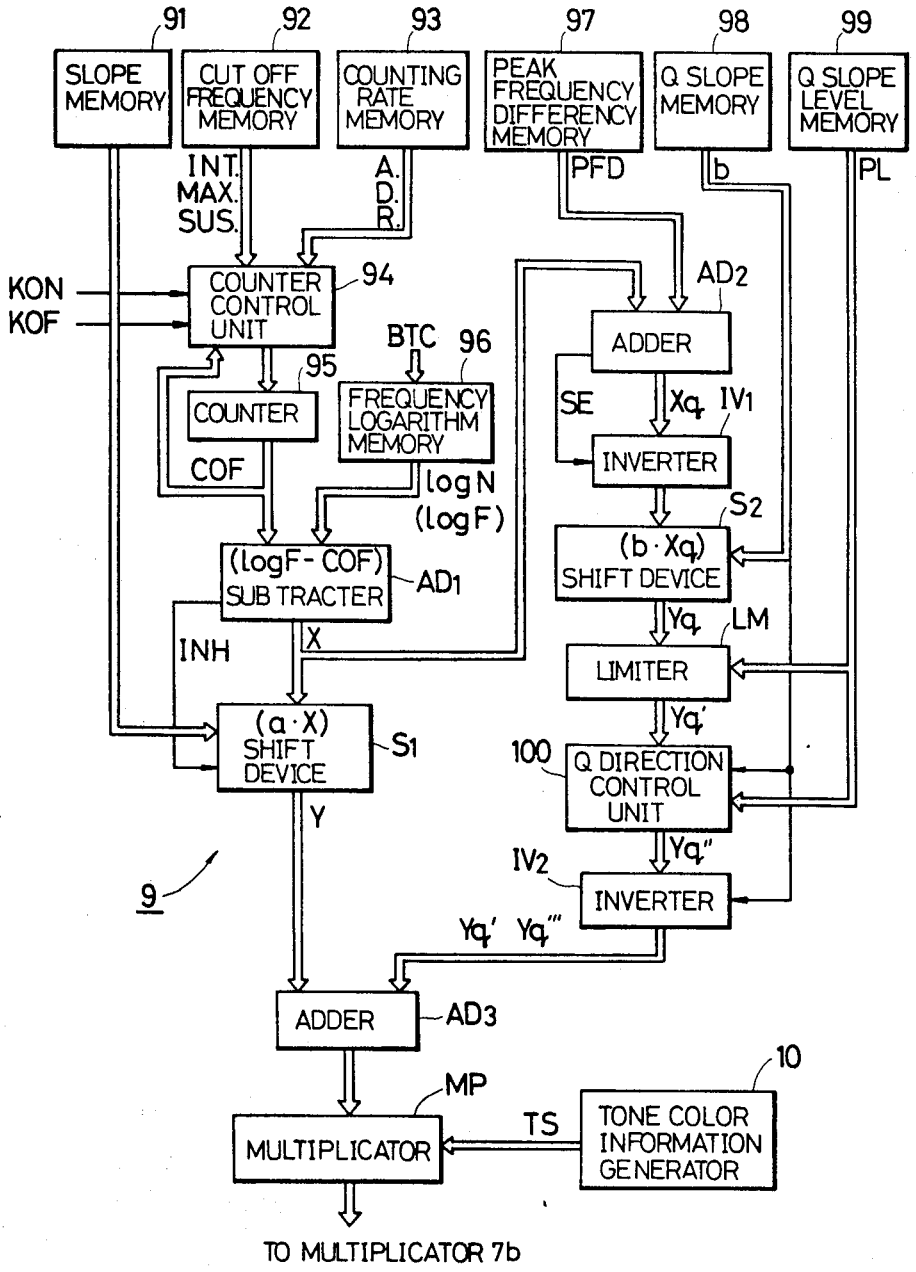
FIG. 3 is a block diagram showing an essential part of the electronic musical instrument shown in FIG. 1.

FIG. 3 shows an example of the filter 9 employed in the electronic musical instrument according to the invention. A slope memory 91 previously stores information corresponding to the inclination a of the slope portion of the filter characteristic. The slope memory 91 in this example has storing capacity of 2 bits and is capable of providing four kinds of inclination information, i.e. 1, ½, ¼ and 0. If, for example, amount of octave attenuation when the inclination a is unity is 12 dB/oct and a frequency range of one octave is divided by 64, resolution of this filter is 0.1875 dB. If the inclination a is one-half, the amount of octave attenuation is 6 dB/oct and if the inclination a is one-fourth, the amount of octave attenuation is 3 dB/oct. In case the filter is not used, the slope portion is cancelled by selecting the inclination a at 0.

The cut-off frequency information COF is produced by a counter 95. The present example is constructed in such a manner that the cut-off frequency successively changes or slides during a period from the start to the end of playing of a musical tone. The counting output of the counter 95 is used as the cut-off frequency information COF which is caused to change successively by controlling the counting in a counter control unit 94 as will be described later. A cut-off frequency memory 92 previously stores an initial count INT, an attack finish count MAX and a sustain count SUS of the counter 95 in various values (e.g. 6 bits). A counting rate (speed) memory 93 previously stores information corresponding to an initial rate (speed) A, a first decay rate D and a second decay rate R in various values (e.g. 5 bits). The counting rate (speed) of the counter 95 is determined in accordance with the information A, D and R. A counter control unit 94 is provided for controlling the counting operation of the counter 95 in response to key-on information KON and key-off information KOF supplied from the key assigner 2 and information supplied from the memories 92 and 93. For example, the initial count information INT is applied from the memory 92 to the counter 95 at the instant of key-on to start counting at the initial counting rate A. The initial count INT first is provided from the counter 95 as the cut-off frequency information COF and thereafter the value of the information COF changes as the counting proceeds. The counter control unit 94 detects that the count in the counter 95 has reached the attack finish count MAX and thereupon causes the counter 95 to proceeds with counting from the attack finish count MAX to the sustain count SUS at the first decay rate D. The counter 95 stops counting when the count has reached the sustain count SUS which count thereafter is maintained. When the key has been released, the counter 95 proceeds with counting from the sustain count SUS to the initial count INT. Discrimination between addition and subtraction is made by comparing the respective counts INT, MAX and SUS. An accumulator may be utilized as the counter 95 in which case it sequentially accumulates the rate information supplied from the memory 93 to the count supplied from the memory 92 with a certain interval.

Figure 1:
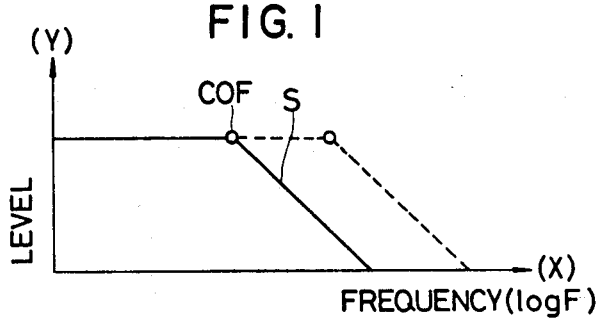
FIG. 1 is a graphical diagram for explaining the basic principle of the present invention.
Figure 4A:
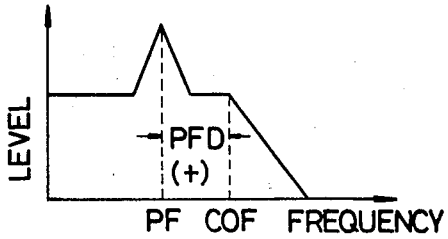
FIGS. 4(*a*) – (*f*) are graphical diagram showing output characteristics of various parts of the embodiment shown in FIG. 3.
Figure 4B:
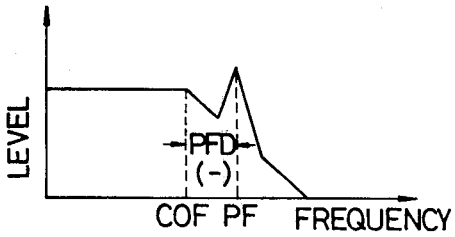
Figure 4C:
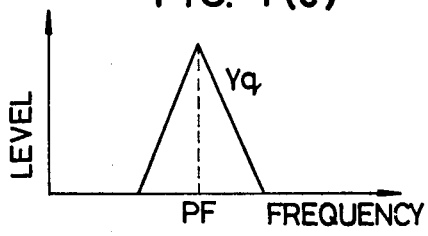
Figure 4D:
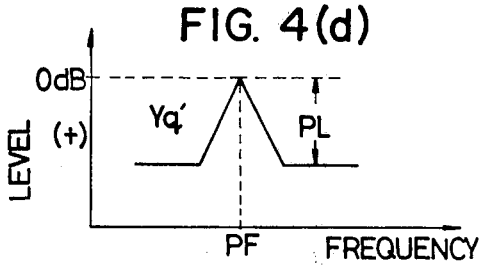
Figure 4E:
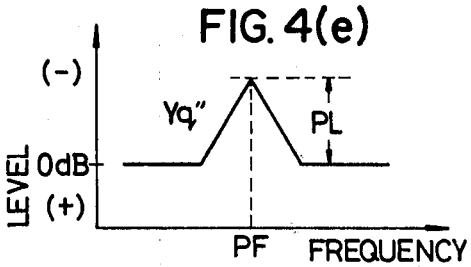
Figure 4F:
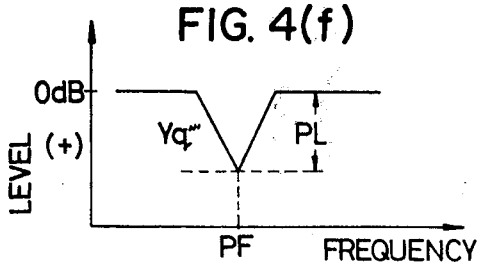

A frequency logarithm memory 96 previously stores, in a logarithmic form, information representing frequencies of respective harmonics for every note to be designated by key depressions. Information F corresponding to the frequency of the depressed key is basically expressed as $F = N \cdot R$ where $R$ represents tone pitch (fundamental frequency) of the note and $N$ represents order number of the harmonic. In this case, the information F changes in accordance with change in the fundamental frequency (i.e. tone pitch R) of the tone and therefore the level information Y obtained by calculation in connection with the filter curve takes different values for the same order of harmonics if the tone pitches are different. Such manner of filtering may conveniently be termed "fixed formant". (i.e. the filtered level is fixed relative to the absolute value of the actual frequency) If, on the other hand, the ratio of the harmonic components only is to be controlled regardless of the tone pitch corresponding to the depressed key, the information F to be stored in the memory 96 has only to relate to the harmonic order $N$ (i.e. $F = N$). In this case, the origin of the X-distance frequency in the filter characteristic shown in FIG. 1 is set at the fundamental frequency (i.e. the first harmonic) and variables in the X-distance are respective harmonic orders. This type of control may be termned "floating formant" (i.e. the filtered level does not change in accordance with order of a harmonic but changes in accordance with the absolute value of the frequency.). The frequency logarithm memory 96 employed in the present embodiment is constructed in the form of floating formant, storing frequency logarithm information log N for the first to eighth(n-th) harmonics (in this text "first harmonic means fundamental"). This information log N which is used as log F in the calculation is 0 for the first harmonic 12 for the second harmomic, 24 for the fourth harmonic and 36 for the eighth harmonic . . . . , i.e. $\log N = 12 \log_2 n$. The memory 96 is addressed by the order-of-harmonic signal BTC supplied from the key assigner 2 to sequentially and successively produce the logarithm information log $N$ for the respective harmonic frequencies. The information $a$, INT, MAX, SUS, A, D and R stored in the memories 91, 92 and 93 can be read out as desired by the performer by operation of a filter selection switch (not shown).

An adder $AD_1$ carries out subtraction "log F − COF" of the formula (2) upon application thereto of the cut-off frequency COF (in logarithm) and the logarithm information log F (i.e. log $N$) to obtain variable information X required for calculating the slope portion. A shift device $S_1$ carries out multiplication of the formula (1) upon application thereto of the variable information X and the inclination information $a$ to successively produce the level information Y for the respective harmonic components. Since the inclination $a$ changes 1, ½ and ¼, i.e., in powers of 2, multiplication is carried out only by suitably shifting the variable information Y (in binary notation) using the inclination $a$ as shift control information. In the case of a low-pass filter, inhibit signal INH is applied to the shift device $S_1$ when the result of subtraction conducted in the subtractor $AD_1$ becomes a negative number (i.e. frequency to be filtered is lower than the cut-off frequency) thereby compulsorily setting the output Y of the shift device $S_1$ to 0. Since the level information in this embodiment is expressed in the logarithmically expressed attenuation amount, the level information Y which is 0 dB means that the harmonic frequency signal passes the filter without being attenuated by the filter. In the foregoing manner, the level information Y of the slope portions is successively calculated.

A peak frequency difference memory 97 previously stores difference PFD between peak frequency PF of the high Q pass band portion and the cut-off frequency COF. If the cut-off frequency COF is higher than the peak frequency PF of the acute portion of the filter characteristic constituting the high Q pass band portion as shown in FIG. 4 ($a$), the memory 97 stores frequency difference PFD in a positive numerical value, whereas if cut-off frequency COF is lower than the peak frequency PF as shown in FIG. 4($b$), the memory 97 stores the frequency difference in a negative number. The frequency difference information PFD from the memory 97 and the variable information X from the subtractor $AD_1$ are added together in the adder $AD_2$ and the result of addition becomes "log F − COF + PFD". Thus, a deviation $Xq$ of the logarithmically expressed frequency log F from the peak frequency PF is obtained.

Level information $Yq$ of the high Q portion of the filter can be obtained by the following formula (3) which is very similar to the formula (1)

$$Yq = b \cdot Xq \quad (3)$$

where $b$ represents inclination of the slope constituting the acute portion of the filter characteristic.

This inclination $b$ is previously stored in a slope memory 98. The memory 98 stores a slope on one side only of the acute portion. The acute portion has a selectively characteristic of an inverted V shape if the inclination $b$ is a positive number whereas the acute portion has a V-shaped selectivity characteristic if the inclination be is a negative number. The inclination information $b$ is applied to a shift device $S_2$ and absolute value of the inclination $b$ is used as shift control information. The shift device $S_2$ also receives the deviation information $Xq$ through an inverter $IV_1$. The deviation information $Xq$ is suitably shifted in accordance with the inclination information $b$ and the multiplication of the formula (3) is substantially conducted in the shift device $S_2$ to produce the level information $Yq$.

The result of addition in the adder $AD_2$ can take either one of positive and negative values depending upon the value of the variable log F. That is, the result of addition is a positive value in case the deviation $Xq$ belongs to one side of the acute portion and is a negative value in case the deviation $Xq$ belongs to the other side. In case the result of addition (deviation $Xq$) in the adder $AD_2$ is a negative value, a control signal SE is applied to the inverter $IV_1$ to invert the deviation $Xq$ into a positive value. Thus, the inverter $IV_1$ always produces the absolute value of the deviation $Xq$ obtained in the adder $AD_2$. Accordingly, even when only the inclination on one side is read out, the deviation $Xq$ of the inclination on the other side is inverted in the inverter $IV_1$ so that the level information $Yq$(result of multiplication) assumes a correct shape as shown in FIG. 4(*c*) corresponding to the selectivity characteristic of the inverted-V shape.

A Q peak level memory 99 previously stores a peak level of the high Q portion. Peak level information PL read from the Q peak level memory 99 is applied to a limiter LM. The limiter LM is provided for cutting off a level portion of the level information $Yq$ exceeding the set peak level PL. Since the level information is treated as amount of attenuation, the level information is cut off in its skirt portion by the limiter LM having a characteristic as shown in FIG. 4(*d*).

A Q direction control unit 100 is provided for determining an upward or downward direction of the acute portion of the high selectivity characteristic in response to polarity of the inclination information $b$ read from the Q slope memory 98. The unit 100 includes a gate circuit which passes level information $Yq'$ provided from the limiter LM and controlled in its peak level to an inverter $IV_2$ when the inclination information $b$ is a positive value (i.e. directing upward). The inverter $IV_2$ also passes the level information $Yq'$ and supplies it to an adder $AD_3$ when the inclination information $b$ is a positive value. When the inclination information $b$ is a negative value (i.e. directing downward), the Q direction control unit 100, receiving the peak level information PL from the Q peak level memory 99, carries out calculation $Yq' - PL = Yq''$ to produce level information $Yq''$ having a characteristic such as shown in FIG. 4(*c*). If a signal indicating the polarity of the inclination $b$ is designated by a reference character G and if it is assumed that the polarity is positive (i.e. directing upward) when the signal G is 0 whereas it is negative (i.e. directing downward) when the signal G is 1, the control unit 100 substantially carries out calculating $Yq'' = Yq' - g'PL$. If the inclination $b$ is of a negative polarity (i.e. directing downward), the inverter $IV_2$ inverts the polarity of the level information $Yq''$ as shown in FIG. 4(*e*) to a positive side thereby forming level information $Yq'''$ having a downwardly directed selectivity characteristic as shown in FIG. 4(*f*).

The adder $AD_3$ adds the level information Y from the shift device $S_1$ and the level information $Yq'$ (or $Yq'''$) corresponding to the selectivity Q together and thereby produce, by each harmonic component, filter level information having an upward directed selectivity characteristic as shown in FIGS. 4(*a*) and 4(*b*) or filter level information having a downward directed filter characteristic. The output of the adder $AD_3$ (i.e. filter level information) is applied to a multiplicator MP where it is multiplied with the tone color information TS from the tone color information generator 10. Since the tone color information TS and the filter level information are both expressed in a logarithmic form, the multiplicator MP actually conducts addition. In the foregoing manner, the tone color information TS corresponding to the level ratios between the respective harmonic components for realizing a desired musical tone and the filter level information changing its filter characteristic in response to the changing cut-off frequency COF are combined together and level information (amplitude coefficient) for each harmonic component finally determining the tone color is successively provided from the multiplicator MP to the second multiplicator 7*b*.

The above described memories 97, 98 and 99 are adapted to store the peak frequency difference information PFD, peak slope inclination information $b$ and peak level information PL of various values to enable the performer to obtain desired information by operation of the filter selection switch.

The memories 91–93 and 97–99 are only required to have a relatively small storage capacity because they have only to store constant information for calculating the level information of the filter slope portion. For example, a total storage capacity of the memories 91–93 and 97–99 required for achieving a single filter characteristic is less than 100. The storage capacity required increases as the number of filter characteristics selectable by the filter selection switch increases. However, the total capacity of the entire filter 9 with dynamic range of e.g. 0–72 dB and resolution of e.g. 0.1875 dB is in the order of several hundred bits, by far a smaller capacity than is required in the prior art electronic musical instrument.

The foregoing description has been made about the embodiment in which the filter is constructed as a low-pass filter. It will, however, be obvious to those skilled in the art to construct a high-pass filter or a band-pass filter in accordance with the above-described principle of the invention.

What is claimed is:

1. An electronic musical instrument of a type wherein harmonic components are combined to produce a musical tone waveshape comprising:

memory means for storing constant information corresponding to a desired frequency filter characteristic; and calculation means for calculating level information of the particular frequency in said filter characteristic in response to the constant information read from said memory means and information of respective harmonic frequencies;

levels of harmonic components of a musical tone waveshape being controlled in accordance with said level information calculated by said calculation means.

2. An electronic musical instrument as defined in claim 1 in which said memory means store cut-off frequency COF and a slope $a$ of the filter characteristic and wherein said calculation means comprise a first calculation circuit for calculating level information $Y = a$ (log $F - COF$) where $F$ represents an actual frequency.

3. An electronic musical instrument as defined in claim 2 in which said memory means further store difference PFD between peak frequency of high Q portion and the cut-off frequency COF, inclination information $b$ representing inclination of a slope of the high Q portion and a peak level PL and in which said calculation means further comprise:

a second calculation circuit for calculating level information $Yq = b$ (log $F - COF + PFD$);

a limiter for limting the value of the level information $Yq$ when the peak value thereof exceeds the peak level PL and thereupon producing level information $Yq'$;

a Q direction control unit for passing the level information $Yq'$ from said limiter when the inclination information $b$ is a positive value and conducting calculation $Y'' = Yq' - PL$ when the inclination information $b$ is a negative value;

an inverter for inverting the information $Yq''$ to produce information $Yq'''$ when the inclination information $b$ is a negative value and passing the information $Yq'$ when the inclination information $b$ is a positive value; and adder means for conducting additions $Y + Yq'$ and $Y + Yq'''$.

4. An electronic musical instrument as defined in claim 2 further comprising control means for successively changing the cut-off frequency during a period of time from the start to the end of playing of the musical tone.

5. An electronic musical instrument as defined in claim 4 in which said memory means store an initial count, an attack finish count and a sustain count as plural cut-off frequencies;

which further comprises a counting rate memory storing an initial rate, a first decay rate and a second decay rate; and in which said control means comprise;

a counter for producing changing cut-off frequencies as counting output thereof; and a counter control unit for controlling the counting rate of said counter in such a manner that said counter counts, upon keying-on from the initial count to the attack finish count at the initial rate, from the attack finish count to the sustain count at the first decay rate and thereafter maintains the sustain count, and upon keying-off counts from the sustain count to the initial count at the second decay rate.

* * * * *